US007504573B2

(12) United States Patent
Hiramatsu et al.

(10) Patent No.: US 7,504,573 B2
(45) Date of Patent: Mar. 17, 2009

(54) MUSICAL TONE SIGNAL GENERATING APPARATUS FOR GENERATING MUSICAL TONE SIGNALS

(75) Inventors: Mikihiro Hiramatsu, Hamamatsu (JP); Satoru Akaike, Hamamatsu (JP); Satoru Tsutsumi, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 242 days.

(21) Appl. No.: 11/526,918

(22) Filed: Sep. 25, 2006

(65) Prior Publication Data

US 2007/0068368 A1 Mar. 29, 2007

(30) Foreign Application Priority Data

Sep. 27, 2005 (JP) ..... 2005-279320

(51) Int. Cl.
*G10H 1/00* (2006.01)

(52) U.S. Cl. ..... 84/609; 84/600; 84/649

(58) Field of Classification Search ..... 84/600–602, 84/609, 649

See application file for complete search history.

(56) References Cited

U.S. PATENT DOCUMENTS 5,235,125 A * 8/1993 Sato et al. ..... 84/609
5,453,568 A * 9/1995 Tajima et al. ..... 84/609
5,668,337 A * 9/1997 Kondo et al. ..... 84/609
5,696,344 A * 12/1997 Fujimoto ..... 84/609
5,736,663 A * 4/1998 Aoki et al. ..... 84/609
5,777,251 A * 7/1998 Hotta et al. ..... 84/609
5,973,254 A * 10/1999 Yamamoto ..... 84/609
6,143,971 A * 11/2000 Aoki et al. ..... 84/609
6,252,152 B1 * 6/2001 Aoki et al. ..... 84/609
6,639,141 B2 * 10/2003 Kay ..... 84/609
6,740,804 B2 * 5/2004 Shimizu et al. ..... 84/609
6,977,335 B2 * 12/2005 Georges et al. ..... 84/609
7,135,635 B2 * 11/2006 Childs et al. ..... 84/600
7,223,912 B2 * 5/2007 Nishimoto et al. ..... 84/609
7,342,166 B2 * 3/2008 Kay ..... 84/609
2004/0099125 A1 * 5/2004 Kay ..... 84/609
2006/0180005 A1 * 8/2006 Wolfram ..... 84/609

OTHER PUBLICATIONS

"Instructions on MOTIF ES", MOTIF ES Owner's Manual, pp. 60-73, Japan, date unknown.

* cited by examiner

*Primary Examiner*—David S. Warren
(74) *Attorney, Agent, or Firm*—Morrison & Foerster LLP

(57) ABSTRACT

A tone generating portion has a performance play capability for concurrently generating, on the basis of a set of performance information, musical tone signals having various voices each assigned to one of parts. A performance data setting portion chooses, under user's direction, one of performance data sets stored in a performance data set storage portion and makes settings of the various voices applied to musical tone signals for the parts. A developing portion enables generation of musical tone signals for at least one of the parts and disables generation of musical tone signals for the other parts in response to user's direction in a state where respective settings of various voices to be applied to musical tone signals for the parts have been done. A tone range defining portion defines tone range data of the at least one part as representing a tone range including at least pitches of all the musical tone signals specified by the performance information.

9 Claims, 12 Drawing Sheets

FIG.8A

| | voice | tone range | reception ch. number, etc. |
|---|---|---|---|
| part 1 | voice A | | ch1 ··· |
| part 2 | voice B | | ch1 ··· |
| part 3 | voice C | | ch1 ··· |
| part 4 | voice D | | ch1 ··· |

FIG.8B

| | voice | tone range | reception ch. number, etc. |
|---|---|---|---|
| part 1 | voice A | | ch1 ··· |
| part 2 | voice B | | ch1 ··· |
| part 3 | voice C | | ch1 ··· |
| | | | |

FIG.8C

| | voice | tone range | reception ch. number, etc. |
|---|---|---|---|
| part 1 | voice A | | ch1 ··· |
| part 2 | voice B | | ch1 ··· |
| | | | |
| | | | |

MUSICAL TONE SIGNAL GENERATING APPARATUS FOR GENERATING MUSICAL TONE SIGNALS

BACKGROUND OF THE INVENTION

1. Field of the Invention

The present invention relates to a musical tone signal generating apparatus having a performance play capability which enables concurrent generation of musical tone signals having different voices assigned to a plurality of parts on the basis of a set of performance information. The present invention also relates to a computer program for the apparatus.

2. Description of the Related Art

Conventionally, there has been an electronic musical instrument which offers voice play mode and performance play mode for use in user's keyboard performance. Details on the electronic musical instrument are described from page 60 to page 73 of "Instructions on MOTIF ES" offered by Yamaha Corporation.

On this conventional electronic musical instrument, performance information brought on the basis of performance on a keyboard provided for the body of the electronic musical instrument and information brought on the basis of operations of various controllers is sent to a tone generating portion as MIDI massage. In the voice play mode, a set of performance information brought from the keyboard causes the tone generating portion to generate only one musical tone signal having a voice (tone color) which is selected by a user from among a plurality of voices prior to his performance on the keyboard. In the performance play mode, on the other hand, a set of performance information brought from the keyboard causes the tone generating portion to concurrently generate musical tone signals having different voices which compose layers having a plurality of parts. Each of the voices is assigned to a part, respectively. In other words, a set of musical tone signals having various voices assigned to a plurality of parts respectively is concurrently generated in response to a set of performance information. In this specification, a "performance" indicates a set of different voices (e.g., a set of four voices at the maximum). The user chooses one of the "performances" prior to his performance on the keyboard. In the performance play mode, therefore, a key depression by the user causes concurrent generation of a plurality of musical tone signals having various tone colors, resulting in enriched musical tones to be generated.

SUMMARY OF THE INVENTION

As described above, in the conventional performance play mode, musical tone signals having different voices (tone colors) are concurrently generated at the depression of a key. In some cases, however, the user desires to play music by using only one of the voices which are contained in the chosen "performance". In other cases, the user desires to check only his desired voice, ignoring the other voices. In those cases, the user's desired procedures can be achieved by manipulating a selecting switch to select a part to which the user's desired voice is assigned from among a plurality of parts while holding a solo switch down. However, the plurality of parts to each of which a different voice is assigned have their respective tone ranges in which generation of musical tone signals is allowed. In some cases, pitches specified through the user's performance on the keyboard are not fallen within the tone range of the selected part. In those cases, musical tone signals will not be generated in response to the user's performance on the keyboard.

In those cases, the user is required to check the list of voices contained in the current "performance" to find his desired voice. The user is then required to switch to voice play mode to make settings of the voice of musical tone signals in the voice play mode. Alternatively, the user is required to check, on an editing screen, the list of tone colors contained in the current "performance" to delete all the tone colors except his desired voice. The user is then required to change the tone range of the part to which the user's desired tone color is assigned. However, either procedure is complicated for the user and time consuming.

The present invention was accomplished to solve the above-described problems, and an object thereof is to provide a musical tone signal generating apparatus which makes it easy to play music with user's desired one or more of a plurality of voices included in a currently chosen "performance".

The musical tone signal generating apparatus according to the present invention has a tone generating portion for inputting performance information specifying pitch of respective musical tone signals to be generated, and generating the musical tone signals having a pitch determined on the basis of the input performance information. The tone generating portion has a performance play capability that enables, on the basis of a set of performance information, concurrent generation of musical tone signals having different voices each assigned to one of a plurality of parts. The musical tone signal generating apparatus also has a performance data set storage portion for previously storing a plurality of performance data sets each of which specifies various voices applied to musical tone signals for a plurality of parts, the musical tone signals being to be concurrently generated by the tone generating portion on the basis of the set of performance information. Each of the performance data sets includes a plurality of tone range data sets each of which defines a tone range of musical tone signals to be allowed to be generated for one of the parts.

In order to achieve the above-described object, a feature of the present invention is to provide the musical tone signal generating apparatus comprising a performance data setting portion, a developing portion, and a tone range setting portion. The performance data setting portion chooses, under user's direction, one of performance data sets stored in the performance data set storage portion, and makes settings of the various voices applied to musical tone signals for the plurality of parts in accordance with the chosen performance data set, the musical tone signals being to be generated by the tone generating portion. The developing portion enables generation of musical tone signals for at least one of the plurality of parts, and disables generation of musical tone signals for the other parts in response to user's direction in a state where respective settings of various voices to be applied to musical tone signals for the plurality of parts have been done by the performance data setting portion. The tone range defining portion defines the tone range data of the at least one part as representing a tone range including at least pitches of all the musical tone signals specified by the performance information.

The state where respective settings of various voices to be applied to musical tone signals for parts have been done by the performance data setting portion includes following first and second states. In the first state, which is immediately after the selection of a performance data set by the performance data setting portion, the tone generating portion is to concurrently generate musical tone signals for all the parts in response to an input set of performance information. In the second state, in accordance with user's designation, the tone generating portion is to generate musical tone signals only for the at least one part in response to an input set of performance information. The at least one part designated by the user includes one or more parts.

In the above feature of the invention, for example, in response to user's designation of at least one of the plurality of parts, the developing portion enables generation of musical tone signals for the designated at least one part and disables generation of musical tone signals for the other parts. In this case, the tone range defining portion defines, in response to the user's designation of one of the plurality of parts, tone range data of the designated at least one part as representing a tone range including at least pitches of all the musical tone signals specified by the performance information.

The developing portion may include a first developing portion for enabling generation of musical tone signals for at least one of the plurality of parts, and disabling generation of musical tone signals for the other parts in accordance with predetermined criteria in response to user's instructions for developing, and a second developing portion for changing settings made by the first developing portion such that, in response to user's designation of at least one of the plurality of parts, the generation of musical tone signals for the designated at least one part is enabled with the generation of musical tone signals for the other parts being disabled. In this case, the tone range defining portion may define, in response to the user's instructions for developing, tone range data of the plurality of parts as representing a tone range including at least pitches of all the musical tone signals specified by the performance information.

In the present invention configured as described above, the developing portion enables generation of musical tone signals for at least one part and disables generation of musical tone signals for the other parts in accordance with user's instructions. As a result, the tone generating portion generates musical tone signals for only the at least one part. Further, the tone range defining portion defines the tone range data of the at least one part as representing a tone range including at least pitches of all the musical tone signals specified by the performance information. Consequently, even in a case where the tone range defined by the tone range data of the at least one part is narrow, the present invention allows to extend the original tone range of musical tone signals to be generated by the tone generating portion to a tone range including at least pitches of all the musical tone signals specified by the performance information. When the user desires to play music only with his desired one or more voices contained in a currently specified "performance", therefore, the present invention enables the user to cause the musical tone signal generating apparatus, with a simple operation, generate musical tone signals for a voice/voices assigned to the at least one part in response to any received set of performance information.

Another feature of the invention is that the at least one part for which generation of musical tone signals is enabled by the developing portion includes at least another of the plurality of parts, the at least another having the same tone range as that of the at least one part, the tone range being defined by tone range data included in the performance data set. In a case where there exist parts having the same tone range defined by the tone range data contained in the performance data set, this feature enables concurrent generation of musical tone signals for the parts having the same tone range, and causes the tone range defining portion to define respective tone range data of the parts having the same tone rage as representing a tone range including at least pitches of all the musical tone signals specified by the performance information. In this case, it can be considered that the user intends to concurrently generate, in response to the reception of a set of performance information, musical tone signals for the parts having the same tone range. Therefore, this feature enables the musical tone signal generating apparatus to concurrently generate musical tone signals for all the user's intended parts.

Still another feature of the invention is that, for example, the tone generating portion receives performance information having a transmission channel number representative of a source from which the performance information is delivered, and generates musical tone signals having pitches corresponding to the received performance information on condition that the transmission channel number included in the received performance information agrees with a specified reception channel number. Each of the performance data sets stored in the performance data set storage portion contains reception channel numbers each of which allows generation of musical tone signals in accordance with received performance information on condition that the transmission channel number contained in the performance information agrees with the reception channel number. At the settings of the various voices made by the performance data setting portion, the respective reception channel numbers for the plurality of parts have been set at a value identical to the transmission channel number contained in the performance information. The developing portion enables generation of musical tone signals for the at least one part by making a reception channel number for the at least one part agree with the transmission channel number contained in the performance information, and disables generation of musical tone signals for the other parts by making respective reception channel numbers for the other parts disagree with the transmission channel number contained in the performance information. This feature allows, with a simple operation of specifying reception channel numbers, the user to enable generation of musical tone signals for at least one of a plurality of parts specified by a performance data set and disable generation of musical tone signals for the other parts.

A further feature of the invention is that the tone generating portion includes not only the performance play capability but also a voice play capability that enables generation of only a musical tone signal having one voice in response to a set of performance information. The musical tone signal generating apparatus further includes a voice data set storage portion and a voice data setting portion. The voice data storage portion previously stores a plurality of voice data sets each of which specifies a voice of a musical tone signal to be generated in response to the set of performance information. The voice data setting portion chooses, under user's direction, one of the voice data sets stored in the voice data set storage portion, and then making settings of a voice to be applied to a musical tone signal in accordance with the chosen voice data set, the musical tone signal being to be generated by the tone generating portion.

The further feature of the invention configured as above realizes not only the performance play capability for concurrently generating musical tone signals having various voices in response to a received set of performance information but also the voice play capability for generating only the musical tone signal having a voice in response to a received set of performance information. Therefore, this feature provides the user with a choice between generation of musical tone signals by the performance play capability and generation of musical tone signals by the voice play mode.

The present invention can be embodied not only as an invention of the musical tone signal generating apparatus but also as an invention of a computer program and a method applied to the apparatus.

BRIEF DESCRIPTION OF THE DRAWINGS

FIGS. 8A through 8C are diagrams showing examples of a performance data set;

DESCRIPTION OF THE PREFERRED EMBODIMENT a. First Embodiment

Figure 1:
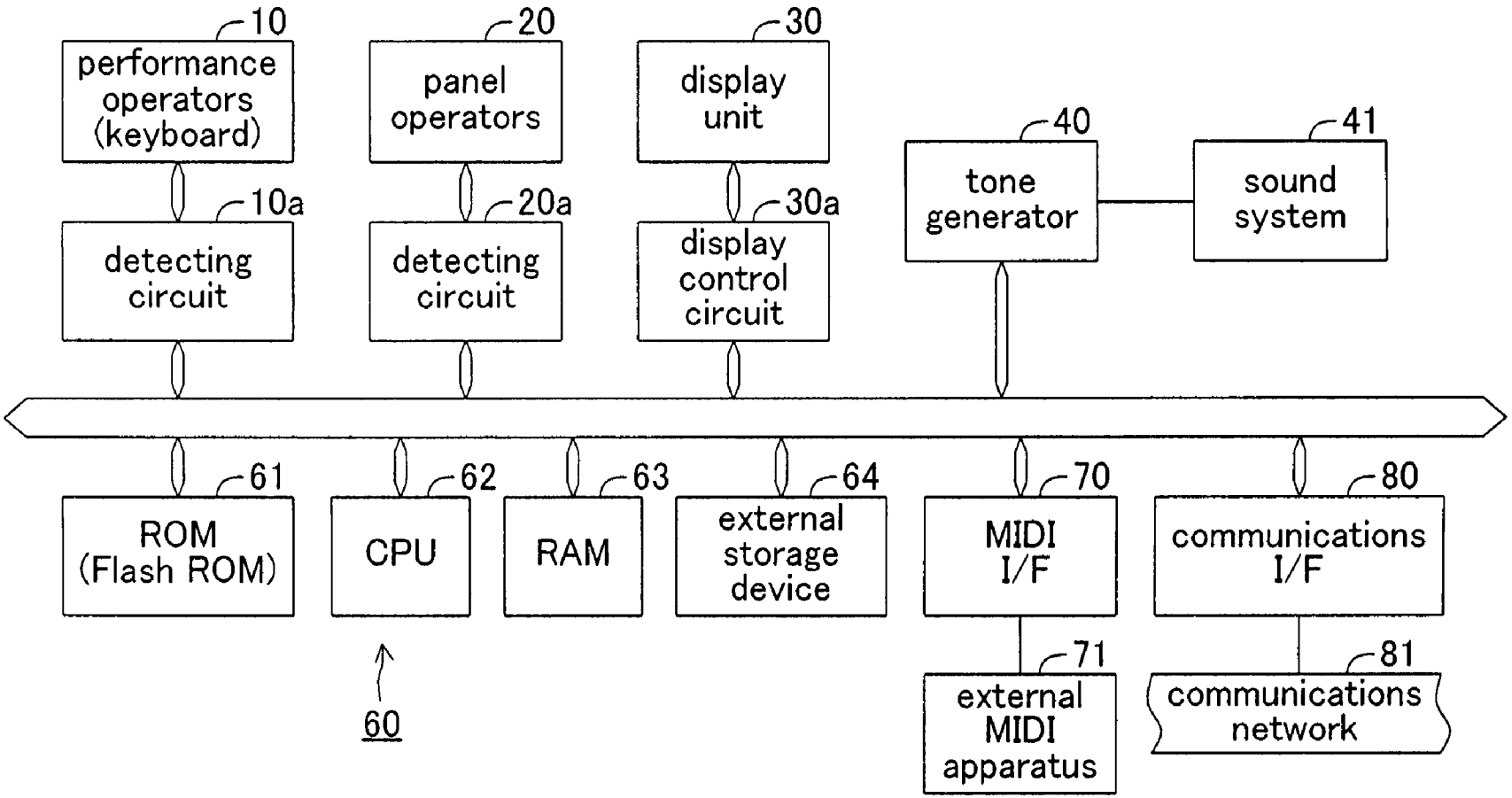
FIG. 1 is a block diagram showing an example hardware configuration of an electronic musical instrument according to a first and second embodiments of the present invention.

A first embodiment of the present invention will now be described. FIG. 1 is a block diagram showing an example hardware configuration of an electronic musical instrument which includes a musical tone signal generating apparatus according to the first embodiment. This electronic musical instrument has performance operators 10, panel operators 20, a display unit 30 and a tone generator 40.

The performance operators 10 are composed of a keyboard having a plurality of keys each corresponding to a different pitch. The performance operators 10 are operated by a player to play music. The depression/release and velocity (key touch) of the respective keys of the performance operators 10 are detected by a detecting circuit 10*a* connected with a bus 50. On the basis of detected depression/release and velocity of a key of the performance operators 10, the detecting circuit 10*a* outputs note number data representative of a depressed or released key and velocity data involved in the key depression. The panel operators 20 are composed of a plurality of setting operators arranged on a front panel of the electronic musical instrument. User's manipulation of the panel operators 20 is detected by a detecting circuit 20*a* connected with the bus 50. The detecting circuit 20*a* outputs information representative of detected manipulation of the panel operators 20.

Figure 2:
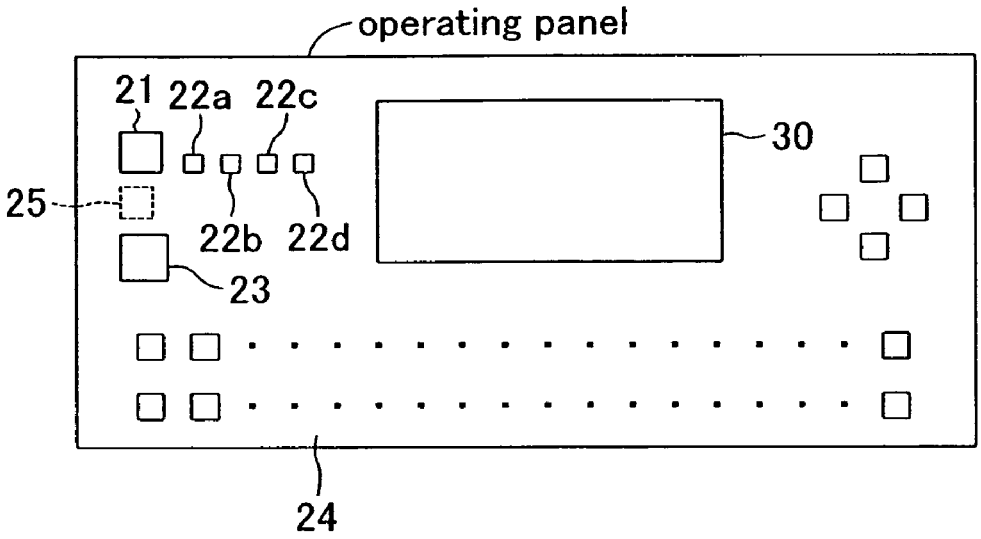
FIG. 2 is a schematic top view of an operating panel of the electronic musical instrument shown in FIG. 1.

As shown in FIG. 2, the panel operators 20 includes a performance play mode operator 21, part specifying operators 22*a* through 22*d*, a voice play mode operator 23 and other setting operators 24. The performance play mode operator 21 is an operator for placing the electronic musical instrument in performance play mode. In performance play mode, based on a set of performance information, musical tone signals having different voices are concurrently generated for a plurality of parts. In performance play mode, there are different types of "performances". In order to choose one of the "performances", a user manipulates the setting operators 24. Each "performance" has a plurality of parts each having a different one of voices that form layers. In the present embodiment, the maximum number of parts contained in each "performance" is four. The part specifying operators 22*a* through 22*d* are associated with the parts, respectively. The user manipulates the part specifying operators 22*a* through 22*d* to specify one or more of the parts included in a selected "performance".

The voice play mode operator 23 is an operator for placing the electronic musical instrument in voice play mode. In voice play mode, a musical tone signal having one voice is generated on the basis of a set of performance information. In voice play mode, there are different types of voices. In order to choose one of the different voices, the user manipulates the setting operators 24.

The setting operators 24 are manipulated in order not only to choose a "performance" or a voice but also to define the entire working of the electronic musical instrument. The display unit 30 is composed of a liquid crystal display provided on the operating panel (see FIG. 2). What is displayed on the display unit 30 is controlled by a display control circuit 30*a* connected with the bus 50.

The tone generator 40, which is connected with the bus 50, has a plurality of musical tone signal generating channels for generating musical tone signals in accordance with performance information (key-on information and key-off information) supplied through the bus 50. Key-on information is composed of key-on data representative of depression of a key (start of generation of a musical tone signal), note number data representative of pitch of the depressed key (pitch of the musical tone signal), and velocity data representative of velocity of the key depression. Key-off information is composed of key-off data representative of release of a key (start of decay of a musical tone signal) and note number data representative of pitch of the released key (pitch of the musical tone signal). On accepting key-on information, the tone generator 40 starts generating a musical tone signal, and then starts decaying the generated musical tone signal in response to accepted key-off information. Subsequent to the start of the decay, the tone generator 40 completes generation of the musical tone signal. The key-on information and key-off information also has a transmission channel number which is given by a later-described computer portion 60. The tone generator 40 generates, at a musical tone signal generating channel specified by the later described computer portion 60, a musical tone signal in response only to key-on information and key-off information having a transmission channel number that agrees with a reception channel number specified by the computer portion 60.

The tone generator 40 is equipped with a plurality of tone source waveform memories for storing data representative of waveforms of tones of various musical instruments as tone source waveform data, various calculating circuits including a DSP (Digital Signal Processor), a D/A converter for converting digital signals to analog signals, and the like. On the basis of performance information, the tone generator 40 generates digital musical tone signals in a manner specified by the computer portion 60 and outputs the generated musical tone signals to a sound system 41. The sound system 41, which includes amplifiers and speakers, converts the digital musical signals supplied from the tone generator 40 to analog musical tone signals and emits musical tones corresponding to the analog musical tone signals through the speakers. In the present embodiment, the tone generator 40 is configured by a hardware circuit. However, the tone generator 40 may be replaced with a software tone generator which generates digital musical tone signals through program processing executed by the computer portion 60.

The electronic musical instrument has the computer portion 60 composed of a ROM 61, a CPU 62, a RAM 63 and an external storage device 64 connected with the bus 50. The ROM 61 stores various computer programs for operating the CPU 62, various song data sets, and various setting data sets. The computer programs include various programs that will be described later. A song data set, which is composed of a performance information string, is data for realizing an automatic performance of a song. Setting data is data for specifying a manner in which the electronic musical instrument operates. In the present embodiment, particularly, at least part of the ROM 61 is configured with a nonvolatile and rewritable memory such as Flash ROM. Flash ROM, which functions as a setting data storing portion, stores various data such as system setting data, various voice data sets corresponding to various voices used in voice play mode, and various performance data sets corresponding to various "performances" used in performance play mode.

Each of the voice data sets, which is composed of control parameters each indicative of a tone source waveform, a frequency response, an effect or the like, defines a manner (tone color defined on the basis of tone source waveform, envelope, effect, etc.) in which musical tone signals are generated by the tone generator 40. Each of the performance data sets is composed of a plurality of data sets provided for respective parts in order to define musical tone signals for the respective parts. Each data set provided for each individual part includes voice data, tone range data, a reception channel number, and the like. The voice data is data for specifying a data set identical to a voice data set for the voice play mode or a data set equivalent to a voice data set for the voice play mode, the voice data set being representative of a manner (tone color specified on the basis of tone source waveform, envelope, effect, etc.) in which musical tone signals for an individual part are generated. Instead of the above-described voice data, the voice data sets themselves or data sets themselves equivalent to the voice data sets may be utilized as the voice data. The tone range data, which is representative of a range within which a part allows generation of musical tone signals, is composed of note number data representative of minimum and maximum pitches of the tone range.

The reception channel number is provided in order to determine whether the part should receive performance information to instruct generation of musical tone signals. In other words, if a transmission channel number included in performance information supplied to the part agrees with the part's reception channel number, the part is allowed to generate musical tone signals on the basis of the supplied performance information. The reception channel number can be changed through user's editing operation. In the present embodiment, however, the reception channel number for all the parts is initially set at "1" as a default setting. As for the transmission channel number, in the present embodiment, performance information about performance by use of the performance operators 10 has the transmission channel number of "1" as a default setting. Through user's editing operation, however, the transmission channel number included in performance information on performance by use of the performance operators 10 can be changed to any value other than "1". In addition, user's editing operation can set a transmission channel number included in performance information externally supplied via a later-described MIDI interface circuit 70 or a communications interface circuit 80 at "1" or any value other than "1".

FIG. 8A shows an example performance data set indicative of a "performance" by which musical tone signals are generated for four parts. FIG. 8B shows an example performance data set indicative of a "performance" by which musical tone signals are generated for three parts. FIG. 8C shows an example performance data set indicative of a "performance" by which musical tone signals are generated for two parts. In the shown examples, the tone range of a part shown by voice A is set from the middle to the bass side. The tone range of a part shown by voice B is set from the middle to the treble side. The tone range of a part shown by voice C is set at the middle range. The tone range of a part shown by voice D is set at the entire ranges from the bass to the treble. The tone range corresponds to the key range to be played by the performance operators 10.

The CPU 62 loads the computer programs stored in the ROM 61 into the RAM 63 to control the electronic musical instrument, using the RAM 63 as working area. Particularly, in accordance with user's performance through the use of the performance operators (keyboard) 10, performance information based on song data stored in the ROM 61, or performance information externally input through the later-described MIDI interface circuit 70 or communications interface circuit 80, the CPU 62 controls generation of musical tone signals by the tone generator 40 in the performance play mode and the voice play mode.

The external storage device 64, which includes nonvolatile storage media such as HDD, FDD and DVD, and drive units for the storage media, stores computer programs and data that are not stored in the ROM 61. These computer programs and data may be previously stored in the external storage device 64. Alternatively, these computer programs and data may be externally loaded through the MIDI interface circuit 70 or the communications interface circuit 80. These computer programs and data are then stored in a Flash ROM of the ROM 61 or the external storage device 64 before use. Alternatively, these computer programs and data are transferred to the RAM 63 for direct use.

The electronic musical instrument also has the MIDI interface circuit 70 and the communications interface circuit 80 that are connected with the bus 50. The MIDI interface circuit 70 is connected to an external MIDI apparatus 71 such as another electronic musical instrument, sequencer, karaoke apparatus, personal computer, and keyboard apparatus. The MIDI interface circuit 70 is capable of inputting computer programs and data that are not stored in the ROM 61 from the external MIDI apparatus 71. The communications interface circuit 80 is connected to a communications network 81 such as the Internet. The communications interface circuit 80 is capable of inputting computer programs and data that are not stored in the ROM 61 from a server connected with the Internet or the like. The input computer programs and data are stored in a Flash ROM of the ROM 61 or the external storage device 64 before use. Alternatively, these computer programs and data are transferred to the RAM 63 for direct use.

Next, operation of the first embodiment configured as described above will be explained. If a player turns on a power switch which is not shown to start the electronic musical instrument and then operates the performance play mode operator 21, the CPU 62 starts executing a performance play mode program shown in FIG. 3 at step S10. After the start of the performance play mode program, at step S11 the CPU 62 stores a previous performance data set (a set of performance data composed of voice data, tone range data, reception channel number, etc.) as a tone source control data set in a tone source control data set area provided in the RAM 63. In a case where the electronic musical instrument has not yet entered the performance play mode since power-on, a performance data set previously specified as a default is selected from performance data sets stored in the ROM 61 to be defined as the tone source control data set. In a case where the electronic musical instrument has already entered the performance play mode after power-on, on the other hand, a performance data set that has been defined as the tone source control data set at the previous operation of the performance play mode is defined as the tone source control data set, since the previous performance data set has been stored in the RAM 63 due to processing of step S13 that will be described later.

At step S12, the CPU 62 assigns a plurality of parts contained in the tone source control data set, i.e., a plurality of parts defined by the tone source control data set as those to generate musical tone signals, to the part specifying operators 22*a* through 22*d*, respectively. In a "performance" by which musical tone signals are generated in four parts as shown in FIG. 8A, for example, parts 1 through 4 are assigned to the part specifying operators 22*a* through 22*d*, respectively. In a "performance" by which musical tone signals are generated in three parts as shown in FIG. 8B, parts 1 through 3 are assigned to the part specifying operators 22*a* through 22*c*, respectively, with the part specifying operator 22*d* being disabled. In a "performance" by which musical tone signals are generated in two parts as shown in FIG. 8C, parts 1 and 2 are assigned to the part specifying operators 22*a* and 22*b*, respectively, with the part specifying operators 22*c* and 22*d* being disabled.

After step S12, the CPU 62 proceeds to step S13 to store the current tone source control data set in the RAM 63 as the previous performance data set in order to allow the reuse of the performance data set at step S11. Instead of the RAM 63, the Flash ROM of the ROM 61 can store the current tone source control data set as the previous performance data set. In this case, without using the performance data set previously specified as a default at step S11, the previous performance data set stored in the Flash ROM can be utilized. After step S13, the performance play mode program is terminated at step S14.

In a state where the tone source control data set has been set as described above, if the player operates the performance operators 10 to play music, the CPU 62 executes a musical tone signal generating program which is not shown to control, on the basis of the tone source control data set, generation of musical tone signals by the tone generator 40, the musical tone signals corresponding to the player's operation. The control of generation of musical tone signals by the musical tone signal generating program is shown in a functional block diagram of FIG. 9. This functional block diagram shows functions achieved in collaboration between program processing by the computer portion 60 and the hardware configuration (ROM 61, CPU 62, RAM 63 and external storage device 64), and the detecting circuit 10*a*, bus 50 and tone generator 40. A transmitting portion BL1 adds a transmission channel number to performance information brought through user's operation of the performance operators 10. In this case, the transmission channel number to be added to the performance information is "1", since the transmission channel number for the performance operators 10 is set at a default of "1". The performance information to which the transmission channel number has been added is then received by a receiving portion BL2. The receiving portion BL2 supplies the received performance information and the transmission channel number to a musical tone signal generating portions BL3 through BL6.

Figure 9:
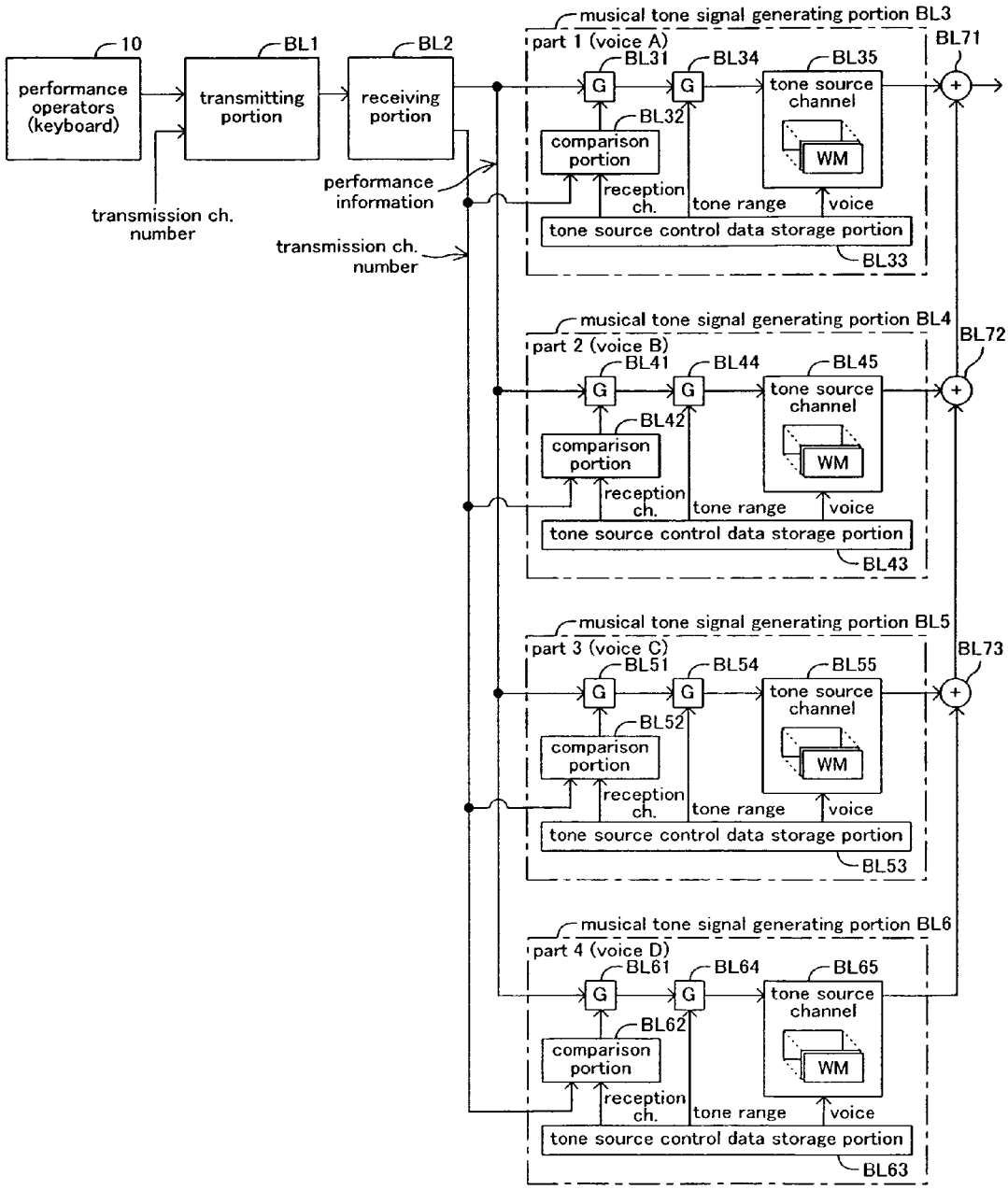
FIG. 9 is a functional block diagram showing musical tone signal generating capability achieved by program processing in performance play mode.

The musical tone signal generating portions BL3 through BL6 are the portions that generate musical tone signals for their corresponding parts. On the basis of the tone source control data set provided in the RAM 63, the musical tone signal generating portions BL3 through BL6 control generation of musical tone signals, respectively, in accordance with input performance information. The four musical tone signal generating portions BL3 through BL6 shown in FIG. 9 show a case where the performance data set provided as the tone source control data set defines four parts as in the case of FIG. 8A. In a case where the performance data set provided as the tone source control data set defines three parts as in the case of FIG. 8B, the musical tone signal generating portions BL3 through BL5 shown in FIG. 9 exist, however, the musical tone signal generating portion BL6 does not exist (i.e., disabled). In a case where the performance data set provided as the tone source control data defines two parts as in the case of FIG. 8C, the musical tone signal generating portions BL3 and BL4 shown in FIG. 9 exist, however, the musical tone signal generating portions BL5 and BL6 do not exist (i.e., disabled). Hereinafter, a case where the musical tone signal generating portions BL3 through BL6 exist (i.e., enabled) based on the performance data set shown in FIG. 8A will be described.

The performance information supplied from the receiving portion BL2 to the musical tone signal generating portions BL3 through BL6 is input to respective gate portions BL31 through BL61. The transmission channel number supplied from the receiving portion BL2 to the musical tone signal generating portions BL3 through BL6 is input to respective comparison portions BL32 through BL62. Tone source control data storage portions BL33 through BL63 correspond to a tone source control data set storage area provided in the RAM 63. Each of the tone source control data storage portions BL33 through BL63 stores its corresponding one of four data sets contained in the performance data set defined as the tone source control data set, the four data sets corresponding to the parts 1 through 4, respectively.

The comparison portions BL32 through BL62 respectively compare the transmission channel number with a reception channel number contained in their respective data set stored in the tone source control data storage portions BL33 through BL63. If the comparison results in a match, the comparison portions BL32 through BL62 whose comparison resulted in a match allow their corresponding gate portions BL31 through BL61 to deliver the performance information. In this case, the transmission channel number is set at "1", and the reception channel number of the respective parts is also set at "1", resulting in the respective sets of performance information of the parts 1 through 4 passing through the respective gate portions BL31 through BL61 to be delivered to gate portions BL34 through BL64, respectively.

The gate portions BL34 through BL64 supply the input performance information to tone source channels BL35 through BL65 only when a pitch represented by note number data contained in the performance information falls within a tone range represented by tone range data contained in their respective data sets stored in the tone source control data storage portions BL33 through BL63. As a result, only in a case where a pitch represented by the received performance information falls within a tone range represented by tone range data, the received performance information is supplied to the corresponding one of the tone source channels BL35 through BL65. In the other cases, the received performance information will neither be delivered to the corresponding one of the tone source channels BL35 through BL65 nor used for generating musical tone signals.

The tone source channels BL35 through BL65 are musical tone signal generating channels for generating corresponding one of four musical tone signals contained in a "performance" in the tone generator 40, respectively. Each of the tone source channels BL35 through BL65 generates a musical tone signal having a pitch corresponding to note number data contained in the supplied performance information and having a voice (tone color) specified by voice data contained in the data set stored in its corresponding tone source control data storage portions BL33 through BL63. Velocity data contained in the supplied performance information is used to control the loudness, envelope waveform and the like of a musical tone signal to be generated. "WM" provided in the shown tone source channels BL35 through BL65 indicates a memory which stores tone source waveforms which are a significant element for determining a voice. The thus generated musical tone signals are combined by adders BL71 through BL73 to output the resultant signals. The adders BL71 through BL73 are incorporated in the tone generator 40. Musical tones corresponding to musical tone signals combined by the adders BL 71 through BL73 are emitted through the sound system 41.

In the above description, a case where the musical tone signal generating portions BL3 through BL6 shown in FIG. 9 exist (enabled), based on the performance data set shown in FIG. 8A. In cases where musical tone signals are generated on the basis of the performance data of FIG. 8B or FIG. 8C, however, only some of the musical tone signal generating portions BL3 through BL6 shown in FIG. 9 work (enabled). More specifically, musical tone signals are generated, as in the above-described case, only by the enabled musical tone signal generating portions.

When the player operates the performance play mode operator 21 and immediately starts a performance by use of the performance operators 10, therefore, the player's operation of one of the performance operators 10 causes musical tone signals for a plurality of parts specified by the previous performance data set to be generated. In this case, if a pitch specified by a player's operated performance operator falls outside the tone rage of a part represented by the tone range data contained in the performance data set, the musical tone signal will not be generated for the part.

Next, a case where in the above-described state the player operates the operators 24 included in the panel operators 20 to choose one of the performance data sets stored in the ROM 61 will be explained. In this case, the player's manipulation of choosing a performance data set causes the CPU 62 to start executing a performance data set change program at step S20 shown in FIG. 4.

After the start of the performance data set change program, the CPU 62 reads out from the ROM 61 the performance data set chosen through the manipulation of the panel operators 24 at step S21. In a case where performance data sets are stored in the external storage device 64, the performance data set stored in the external storage device 64 may be chosen to be loaded. In a case where performance data sets are available from the external MIDI apparatus 71 or the communications network 81, in addition, the player may load the performance data set from the external MIDI apparatus 71 or the communications network 81. Then at step S22, the CPU 62 stores the chosen performance data set as a tone source control data set in the tone source control data set area provided in the RAM 63. After the step S22, the CPU 62 executes steps S23, S24 which are similar to the steps S12, S13 to terminate the performance data set change program at step S25.

In a state where the chosen tone source control data set has been set as described above, if the player operates the performance operators 10 to play music, the CPU 62 executes the musical tone signal generating program which is not shown as in the above-described case to control, on the basis of the tone source control data set, generation of musical tone signals by the tone generator 40, the musical tone signals corresponding to the player's operation. In this case, therefore, the player's operation of one of the performance operators 10 causes musical tone signals having voices assigned to a plurality of parts specified by the newly chosen performance data set to be generated. In this case as well, if a pitch specified by the player's operated performance operator falls outside the tone rage of a part represented by the tone range data contained in the newly chosen performance data set, the musical tone signal will not be generated for the part.

Next, developing of a "performance" will be explained. In this case, the player operates, in the above-described performance play mode, one of the part specifying operators 22*a* through 22*d*. In response to the player's operation of one of the part specifying operators 22*a* through 22*d*, the CPU 62 starts executing a performance developing program at step S30 shown in FIG. 5. After the start of the performance developing program, the CPU 62 determines at step S31 whether the electronic musical instrument is currently placed in the performance play mode or not. If not, the CPU 62 makes a negative determination at step S31 to terminate the performance developing program at step S35. If the electronic musical instrument is in the performance play mode, on the other hand, the CPU 62 makes a positive determination at step S31 to proceed to step S32.

At step S32, the CPU 62 determines, on the basis of the currently specified tone source control data set, whether generation of musical tone signals (i.e., a voice) is assigned to a part that corresponds to the part specifying operator that the player has operated. If not, the CPU 62 makes a negative determination at step S32 to terminate the performance developing program at step S35. If yes, on the other hand, the CPU 62 makes a positive determination at step S32 to proceed to steps S33, S34. In a case where the currently specified tone source control data set is the one shown in FIG. 8A, more specifically, whichever the player may have chosen from among the part specifying operators 22*a* through 22*d*, a positive determination is made at step S32. In a case where the currently specified tone source control data set is the one shown in FIG. 8B, if the player has chosen any one of the part specifying operators 22*a* through 22*c*, a positive determination is made at step S32. If the player has chosen the part specifying operator 22*d*, however, a negative determination is made at step S32. In a case where the currently specified tone source control data set is the one shown in FIG. 8D, if the player has chosen either of the part specifying operators 22*a* and 22*b*, a positive determination is made at step S32. If the player has chosen either of the part specifying operators 22*c* and 22*d*, however, a negative determination is made at step S32.

At step S33, the CPU 62 keeps or sets the reception channel number of the part specified by the operated part specifying operator at the same value as the transmission channel number (in this case, "1"), the reception channel number being contained in the tone source control data set, while the CPU 62 sets the reception channel number of the other parts at a value other than the transmission channel number (e.g., "0", "2", etc.). When the part specifying operator 22*a* has been operated, more specifically, the reception channel number of the part 1 is kept or set at the same value as the transmission channel number, while the reception channel number of the parts 2 through 4 is set at a value other than the transmission channel number.

At step S34, the CPU 62 defines the tone range data of the player's chosen part as representing the full range, the tone range data being contained in the tone source control data. When the part specifying operator 22*a* has been operated, more specifically, the tone range data of the part 1 is defined as the full range. The full range is a tone range which includes more pitches than a tone range that includes at least pitches of all the musical tone signals to be specified by performance information to be input. In other words, the full range indicates the widest possible tone range for electronic musical instruments.

In this state, if the player operates the performance operators 10 to play music, the CPU 62 executes the musical tone signal generating program which is not shown to control, on the basis of the specified tone source control data set, generation of musical tone signals by the tone generator 40, the musical tone signals corresponding to the player's operation. In the musical tone signal generating portions BL3 through BL6 shown in FIG. 9, in this case, on the basis of the control of the gate portions BL31 through BL61 by the comparison portions BL32 through BL62, performance information is supplied only to the tone source channel of the musical tone signal generating portion which corresponds to the player's specified part. In the musical tone signal generating portions corresponding to the other parts, performance information will not be supplied to their tone source channels. In this case, the tone source control data storage portion of the specified musical tone signal generating portion outputs tone range data representative of the full range, resulting in the musical tone signal generating portion allowing any set of performance information to be unconditionally supplied to its tone source channel through the gate portion which is controlled on the basis of the tone range data. The tone source channel to which performance information has been delivered generates a musical tone signal having a pitch corresponding to note number data contained in the delivered performance information and having a voice (tone color) specified by voice data stored in the tone source control data storage portion. In this case as well, velocity data contained in the delivered performance information is utilized for the control of loudness, envelope waveform and the like of the musical tone signal to be generated. A musical tone corresponding to the generated musical tone signal is emitted through the sound system 41.

The above-described case will be explained concretely with a case where the part 1 has been specified by the player being taken as an example. The reception channel number output from the tone source control data storage portion BL33 of the musical tone signal generating portion BL3 is the same as the transmission channel number (i.e., "1"), however, the reception channel number output from the tone source control data storage portions BL43 through BL63 of the other musical tone signal generating portions BL4 through BL6 is different from the transmission channel number. In the musical tone signal generating portion BL3, as a result, received performance information passes through the gate portion BL31 under the control of the comparison portion BL32. In the musical tone signal generating portion BL3, since the tone range data delivered from the tone source control data storage portion BL33 to the gate portion BL34 represents the full range, the gate portion BL34 also allows the performance information to pass through to be supplied to the tone source channel BL35. In the musical tone signal generating portions BL4 through BL6, on the other hand, under the control of the comparison portions BL42 through BL62, received performance information is not allowed to pass through the gate portions BL41 through BL61, resulting in the tone source channels BL45 through BL65 not receiving the performance information. The tone source channel BL35 then generates a musical tone signal having a pitch corresponding to note number data contained in the delivered performance information and having a voice (tone color) specified by voice data stored in the tone source control data storage portion BL33.

Next, a case where another of the part specifying operators 22*a* through 22*d* has been operated to make settings of the performance developing mode as in the case of the above will be described. In this case as well, the CPU62 executes the performance developing program shown in FIG. 5. In this performance developing program as well, on condition that the electronic musical instrument is currently placed in the performance play mode with generation of musical tone signals (i.e., a voice) being assigned to another part corresponding to the operated another part specifying operator, steps S33, S34 are executed. More specifically, the reception channel number of the another part specified by the operated part specifying operator is set at the same value as the transmission channel number (in this case as well, "1"), while the reception channel number of the other parts is set at a value other than the transmission channel number (e.g., "0", "2", etc.), the reception channel number being contained in the tone source control data set. In addition, the tone range data of the another part is defined as representing the full range. Then, player's operation of the performance operators 10 to play music causes generation of musical tone signals having the voice of the another part.

If the part specifying operator 22*b* has been operated as the another part, for example, the reception channel number of the part 2 is set at the same value as the transmission channel number, while the reception channel number of the parts 1, 3, 4 is set at a value other than the transmission channel number. The tone range data of the part 2 is defined as representing the full range. In this case, as a result, player's operation of the performance operators 10 causes only musical tone signals having the voice of the part 2 to be generated.

As described above, in a state where the electronic musical instrument is in the performance play mode with a performance data set being specified as a tone source control data set, even in a state where musical tone signals of a plurality of parts are to be concurrently generated or in a state of the performance developing mode, user's simple operation of operating one of the part specifying operators 22*a* through 22*d* enables a performance using only a desired one of the voices assigned to the parts, the voices being included in the currently chosen "performance". Because the tone range data of the part chosen in the performance developing mode has been defined as representing the full range, a musical tone signal is to be generated in response to any set of performance information brought on the basis of the player's operation of the performance operators 10.

In the above description about developing of a "performance", a case where only one of the part specifying operators 22*a* through 22*d* is operated was described, however, concurrent operation of a plurality of part specifying operators can cause concurrent developing of a plurality of parts. In this case as well, on condition that the electronic musical instrument is currently placed in the performance play mode with generation of musical tone signals (i.e., voices) being assigned to the parts corresponding to the concurrently operated part specifying operators, the reception channel number of the parts specified by the concurrently operated part specifying operators is set at the same value as the transmission channel number, while the reception channel number of the other parts is set at a value other than the transmission channel number, the reception channel number being contained in the tone source control data set. In addition, the tone range data of the parts is defined as representing the full range. In this case, as a result, player's operation of the performance operators 10 to play music causes concurrent generation of musical tone signals having the voices of the parts.

Figure 3:
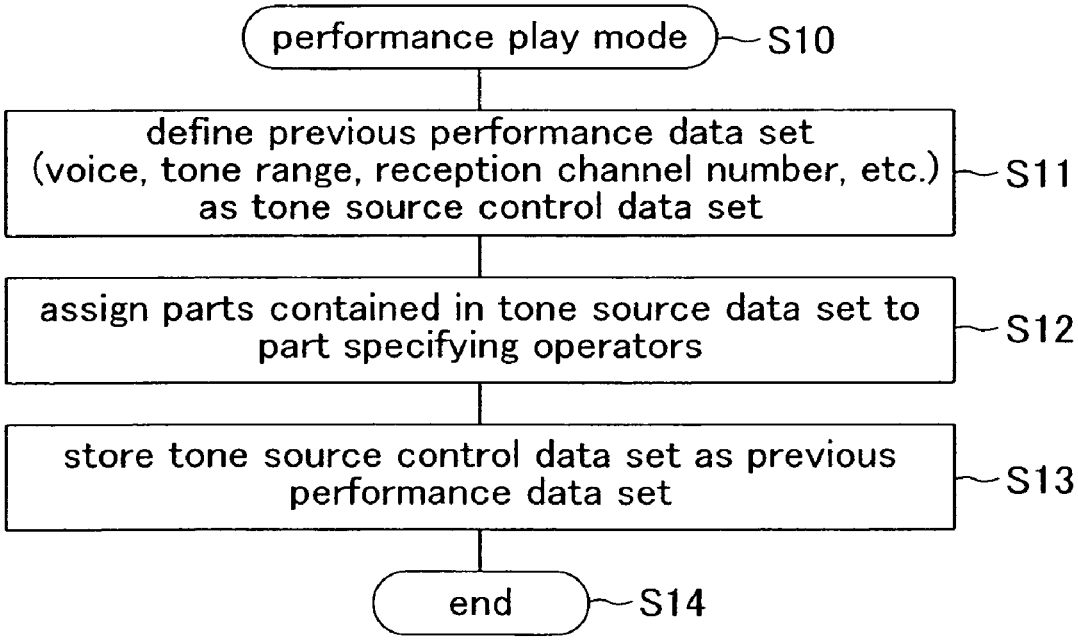
FIG. 3 is a flowchart showing a performance play mode program executed by a computer portion shown in FIG. 1 according to the first embodiment of the present invention.

In such a state where a "performance" is being developed, if the player operates the performance play mode operator 21, the above-described performance play mode program shown in FIG. 3 is executed. As described above, in the performance play mode program, by the step S11, the previous performance data set stored in the RAM 63 by the step S13 is redefined as tone source control data set. In this state, if the player operates the performance operator 10 to play music, musical tone signals of all the parts specified by the tone source control data set in the performance play mode are generated.

Next, the voice play mode will be explained. If the player operates the voice play mode operator 23, the CPU 62 starts executing a voice play mode program shown in FIG. 6 at step S40. After the start of the voice play mode program, the CPU 62 stores, at step S41, a previous voice data set (tone source waveform, frequency response, effect, etc.) as a tone source control data set in the tone source control data set area provided in the RAM 63. In other words, a tone source control data set stored in the tone source control data set area is replaced with the previous voice data set. In this case as well, if the electronic musical instrument has not yet entered the voice play mode since power-on, a voice data set previously specified as a default from voice data sets stored in the ROM 61 is read out to set the reception channel number at the same value as the transmission channel number. Then, the read-out voice data set and the set reception channel number are set as the tone source control data set. Since the transmission number is set at "1" indicative of the performance operators 10 in the present embodiment, the reception channel number is set at "1". In a case where the electronic musical instrument has entered the voice play mode after power-on, on the other hand, the previous voice data set is set as the tone source control data set, for the previous voice data set has been stored in the RAM 63 by a later-described process of step S42. In this case, the previous voice data set stored in the RAM 63 already has a reception channel number, redefining of a reception channel number is not necessary.

Then, the CPU 62 stores, at step S42, the current tone source control data set in the RAM 63 as the previous voice data set in order to allow the reuse of the voice data set at step S41. Instead of the RAM 63, in this case as well, the Flash ROM of the ROM 61 can store the current tone source control data set as the previous voice data set. In this case, without using the voice data set previously specified as a default at step S41, the previous voice data set stored in the Flash ROM can be utilized. After step S42, the voice play mode program is terminated at step S43.

In a state where the tone source control data set has been set as described above, if the player operates the performance operators 10 to play music, the CPU 62 executes the musical tone signal generating program which is not shown to control, on the basis of the tone source control data set, generation of musical tone signals by the tone generator 40, the musical tone signals corresponding to the player's operation. The control of generation of musical tone signals by the musical tone signal generating program is shown in a functional block diagram of FIG. 10. This functional block diagram also shows functions achieved in collaboration between program processing by the computer portion 60 and the hardware configuration (ROM 61, CPU 62, RAM 63 and external storage device 64), and the detecting circuit 10*a*, bus 50 and tone generator 40. Since this functional block diagram is almost the same as that of the performance play mode, the functional parts of FIG. 10 which are identical to those of FIG. 9 have the same codes as those of FIG. 9 to omit detailed description about them.

Figure 10:
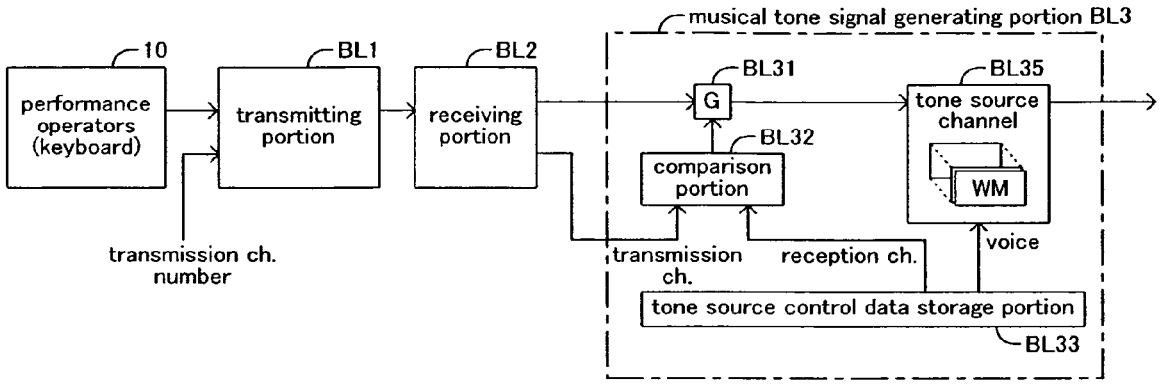
FIG. 10 is a functional block diagram showing musical tone signal generating capability achieved by program processing in voice play mode.

The transmitting portion BL1 adds the transmission channel number (in the present embodiment, "1") to the performance information brought through player's operation of the performance operators 10. The performance information to which the transmission channel number has been added is then delivered to the receiving portion BL2. The receiving portion BL2 supplies the received performance information and the transmission channel number to the musical tone signal generating portion BL3. Because the voice play mode is designed such that a set of performance information results in a musical tone signal to be generated, and has no conception of part, only the musical tone signal generating portion BL3 is shown in FIG. 10. The receiving portion BL2 supplies the performance information to the gate portion BL31 and supplies the transmission channel number to the comparison portion BL32. In this case, since both the transmission channel number and the reception channel number are set at "1", the performance information passes through the gate portion BL31 to be delivered to the tone source channel BL35. In this case, since the voice data set has no tone range data, the gate portion BL34 for controlling passing of performance information on the basis of tone range data shown in FIG. 9 does not exist.

The tone source channel BL35 generates a musical tone signal having a pitch corresponding to note number data contained in supplied performance information and having a voice (tone color) specified by a voice data set stored in the tone source control data storage portion BL33. Velocity data contained in the supplied performance information is used to control the loudness, envelope waveform and the like of the musical tone signal to be generated. A musical tone corresponding to the generated musical tone signal is emitted through the sound system 41. Therefore, when the player operates the voice play mode operator 23 and immediately starts playing music by operating the performance operators 10, the user's operation of a performance operator causes generation of a musical tone signal having a voice (tone color) specified on the basis of the previous voice data set.

Next, a case where the player operates, in the above-described state, the other operators 24 contained in the panel operators 20 to choose one of the voice data sets stored in the ROM 61 will be explained. In this case, the player's operation of choosing a voice data set causes the CPU62 to start executing a voice data set change program at step S50 shown in FIG. 7.

After the start of the voice data set change program, the CPU 62 reads out from the ROM 61 the voice data set chosen through the manipulation of the other operators 24 at step S51. In a case where voice data sets are stored in the external storage device 64, the voice data set stored in the external storage device 64 may be chosen to be loaded. In a case where voice data sets are available from the external MIDI apparatus 71 or the communications network 81, in addition, the player may load the voice data set from the external MIDI apparatus 71 or the communications network 81. Then, the CPU 62 sets, at step S52, the reception channel number at the same value as the transmission channel number and stores the chosen voice data set and the set reception channel number as a tone source control data set in the tone source control data set area provided in the RAM 63. After the step S52, the CPU 62 executes step S53 which is similar to the step S42 to terminate the voice data set change program at step S54.

In a state where the chosen tone source control data set has been set as described above, if the player operates the performance operators 10 to play music, the CPU 62 executes the musical tone signal generating program which is not shown as in the above-described case to control, on the basis of the specified tone source control data set, generation of musical tone signals by the tone generator 40, the musical tone signals corresponding to the player's operation. In this case, as a result, the player's operation of one of the performance operators 10 causes a musical tone signal having a voice specified by the newly chosen voice data set to be generated. Therefore, the electronic musical instrument enables the player to play music not only in the performance play mode but also in the voice play mode.

Figure 6:
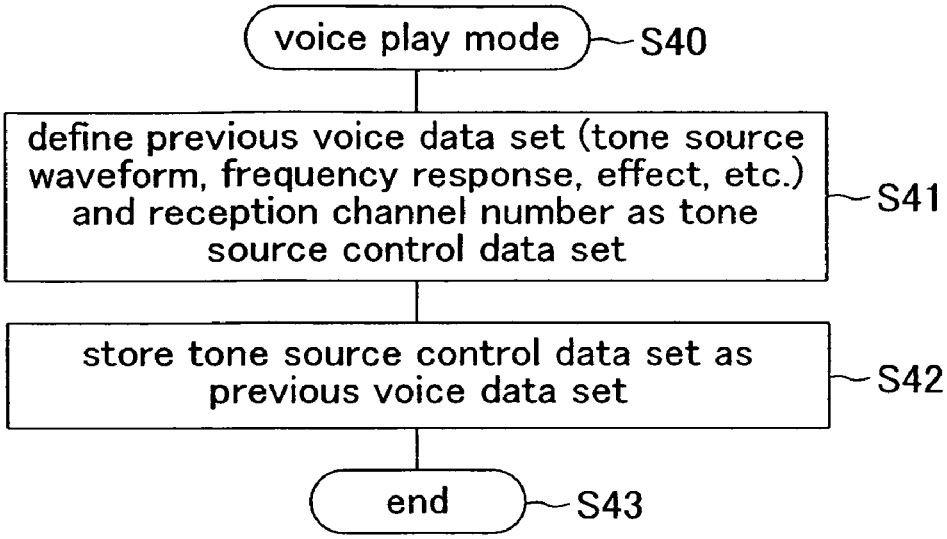
FIG. 6 is a flowchart showing a voice play mode program executed by the computer portion shown in FIG. 1 according to the first embodiment of the present invention.

In the voice play mode, if the player operates the performance play mode operator 21, the performance play mode program shown in FIG. 3 is executed to switch the electronic musical instrument to the performance play mode. In the performance play mode, on the other hand, if the player operates the performance play mode operator 21, the voice play mode program shown in FIG. 6 is executed to switch the electronic musical instrument to the voice play mode.

Figure 5:
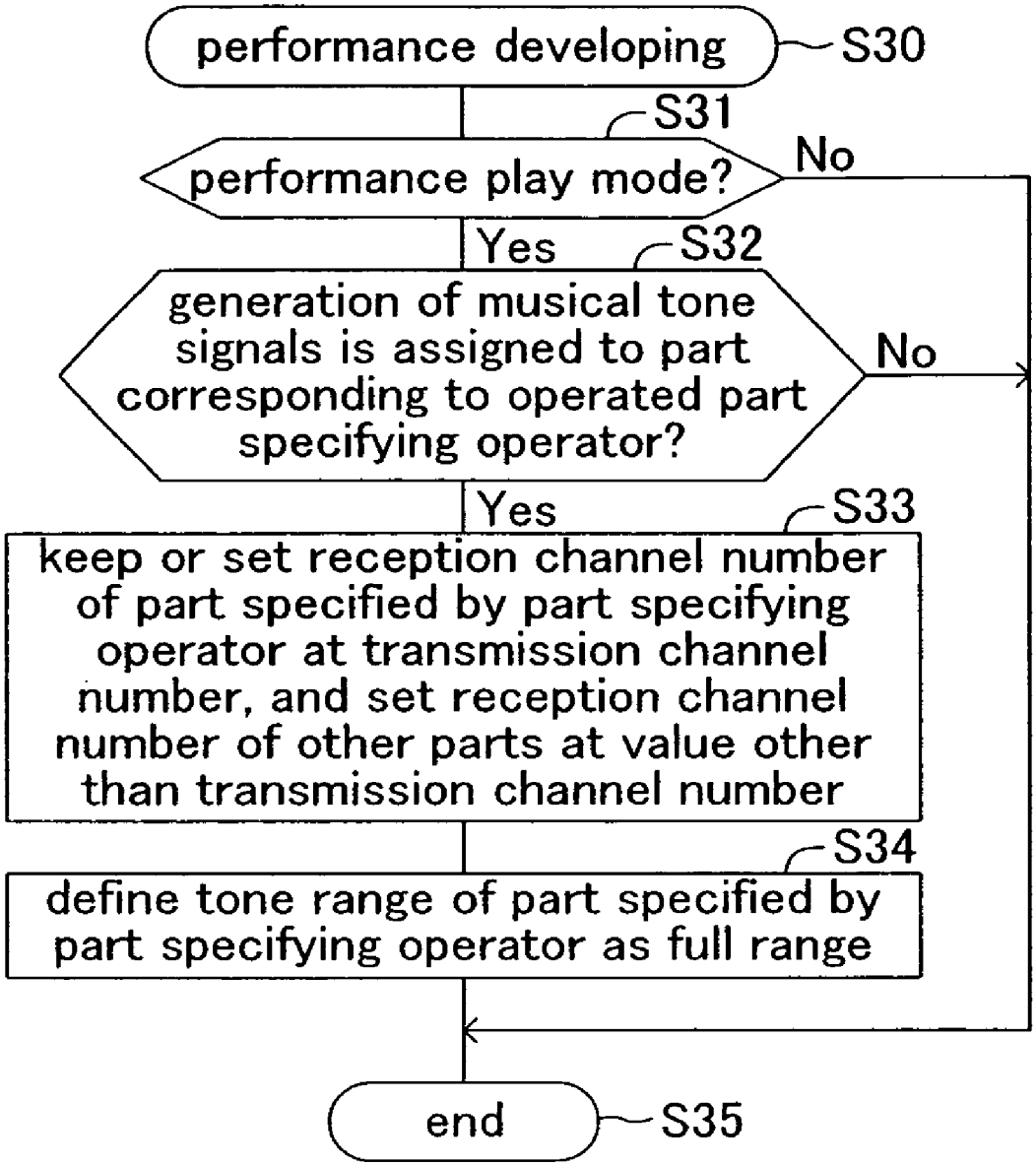
FIG. 5 is a flowchart showing a performance developing program executed by the computer portion shown in FIG. 1 according to the first embodiment of the present invention.

Next, a modified example of the first embodiment will be described. In this modified example, the performance developing program shown in FIG. 5 is replaced with a performance developing program shown in FIG. 11. In the performance developing program shown in FIG. 11, processes of steps S36 through S38 are added between steps S34 and S35 of the performance developing program shown in FIG. 5. At step S36, the CPU 62 searches for another part having a tone range identical to that represented by the previous tone range data of a part/parts specified by the player's operation of the part specifying operators 22*a* through 22*d*. The previous tone range data indicates the tone range data which has not yet been changed by the process of step S34 which changes the tone range to represent the full range. In this case, it is determined on the basis of the previous performance data set stored in the RAM 63 whether there is another part having the tone range data representative of the tone range identical to that represented by the tone range data of the specified part/parts.

If it is determined that there is no part found, the CPU 62 makes a negative determination at step S37 and then terminates the performance developing program at step S35. If a part/parts is/are found, on the other hand, the CPU 62 makes a positive determination at step S37, and executes the processes of steps S38, S39. At step S38, the reception channel number of the found part/parts is set at the same value as the transmission channel number (in the present embodiment, "1"). At step S39, the tone range data of the found part/parts is defined as representing the full range. In this modified example, as a result, player's operation of the performance operators 10 to play music enables concurrent generation of musical tone signals of both the specified part/parts and the found part/parts in accordance with the player's operation of the performance operators 10 to play music. The musical tone signals to be generated are controlled on the basis of the voice data of the specified part/parts and the found part/parts.

In this case, it can be considered that the player intends to concurrently generate, in response to the reception of performance information, musical tone signals for both the player's specified part/parts and the part/parts having the tone range identical to that of the player's specified part/parts. According to this modified example, therefore, the player is allowed to concurrently generate musical tone signals for all the player's intended parts only by specifying one or more parts.

In this modified example, furthermore, in accordance with input performance information, musical tone signals are concurrently generated for the part/parts having the same tone range as that of the specified part/parts without exceptions. Instead of this scheme, however, the modified example may be further modified such that the player is allowed to choose to generate musical tone signals only for the specified part/parts or for both the specified part/parts and the part/parts having the same tone range. In this case, a selection operator for allowing the player to choose to generate musical tone signals for both the parts is provided on the operating panel, with a determination step for determining player's operation of the selection operator being added between the step S34 and the step S36 of FIG. 11. On the basis of the added step, it is determined whether to execute the processes of steps S36 through S39.

Figure 11:
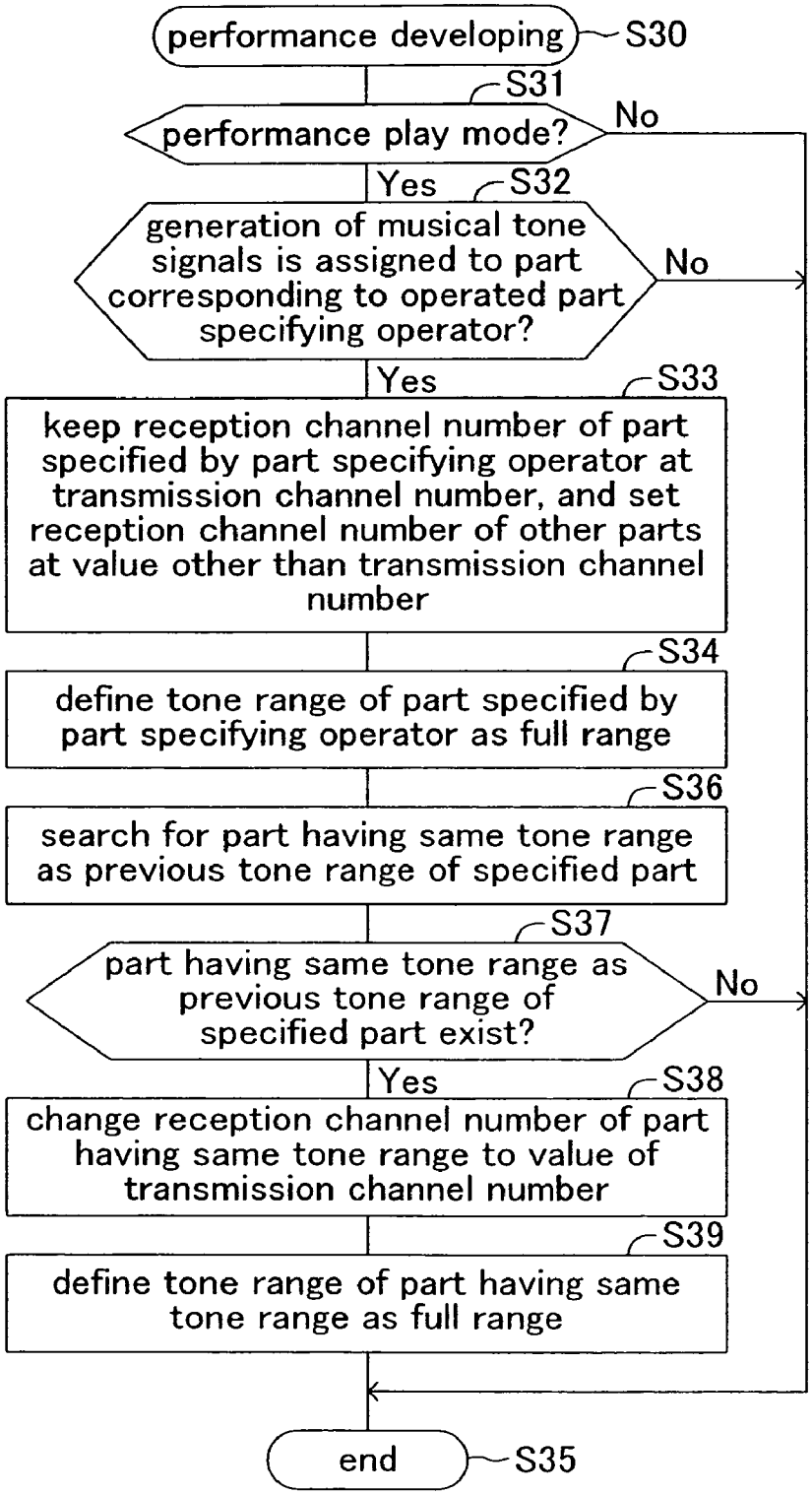
FIG. 11 is a flowchart showing a modified example of the performance developing program shown in FIG. 5.

In the modified example, it is determined by the steps S36, S37 of FIG. 11 whether there is another part having the same tone range as that represented by the previous tone range data of the part/parts specified by the player's operation of the part specifying operators 22*a* through 22*d*. Instead of this scheme, however, the modified example may be further modified such that a part/parts having the same tone range is/are previously provided with identification data representative of possession of the same tone range. Alternatively, the identification data representative of possession of the same tone range may be added when a performance data set is selected. In these modified schemes, if any one of the part specifying operators 22*a* through 22*d* which include the parts having the same tone range is operated by the player, the operated part specifying operator being included in the parts having the same tone range, the parts having the same tone range are concurrently specified at the performance developing on the basis of the identification data.

b. Second Embodiment

Figure 4:
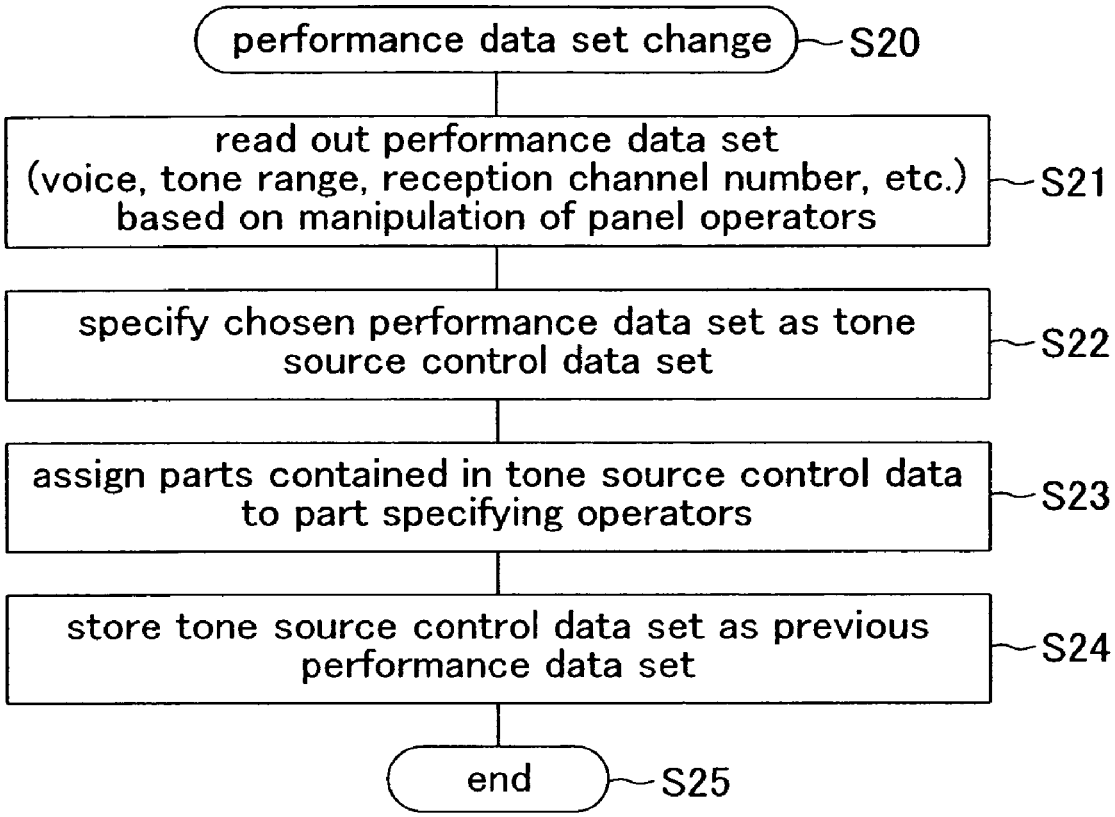
FIG. 4 is a flowchart showing a performance data set change program executed by the computer portion shown in FIG. 1 according to the first embodiment of the present invention.
Figure 7:
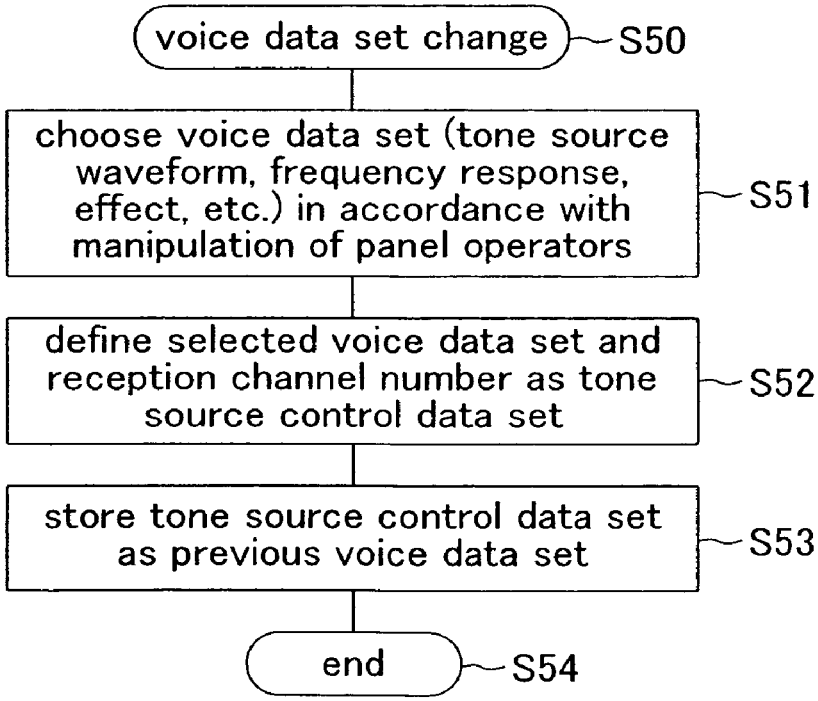
FIG. 7 is a flowchart showing a voice data set change program executed by the computer portion shown in FIG. 1 according to the first embodiment of the present invention.

Next, a second embodiment of the present invention will be described. As shown by broken lines in FIG. 2, the panel operators 20 include a performance developing operator 25. The performance developing operator 25 is used to choose to develop a "performance" in the performance play mode. The hardware configuration of the second embodiment is similar to that of the first embodiment except the performance developing operator 25. In the second embodiment, the performance developing program for the first embodiment shown in FIG. 5 is replaced with a performance developing program shown in FIG. 12 and a part specifying program shown in FIG. 13. As for the following points, the second embodiment is designed similar to the first embodiment. Namely, if the performance play mode operator 21 is operated, the performance play mode program shown in FIG. 3 is executed to enter the performance play mode. If the other operators 24 are operated to choose another performance data set, the performance data set change program shown in FIG. 4 is executed to replace the previous tone source control data set with the another performance data set. If the voice play mode operator 23 is operated, the voice play mode program shown in FIG. 6 is executed to enter the voice play mode. If the other operators 24 are operated to choose another voice data set, the voice data set change program shown in FIG. 7 is executed to replace the previous tone source control data set with the another voice data set.

Figure 12:
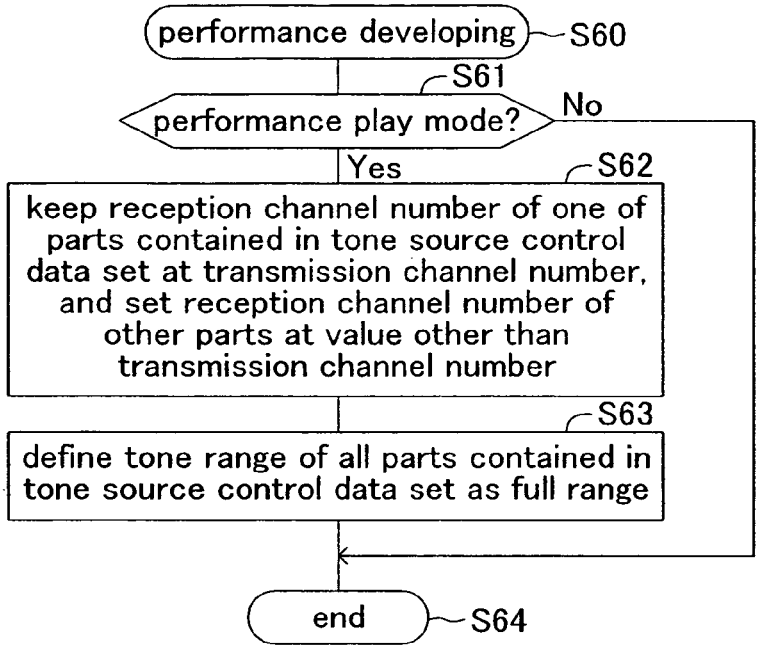
FIG. 12 is a flowchart showing a performance developing program executed by the computer portion shown in FIG. 1 according to the second embodiment of the present invention.

The performance developing program shown in FIG. 12 is started at step S60 in response to the player's operation of the performance developing operator 25. After the start of the performance developing program, the CPU 62 determines at step S61 which is similar to the above-described step S31 of the first embodiment whether the electronic musical instrument is currently placed in the performance play mode or not. Only when the electronic musical instrument is currently in the performance play mode, the CPU 62 executes the processes of steps S62, S63.

At step S62, the CPU 62 keeps the reception channel number of one of the parts contained in the currently set tone source control data set at the same value as the transmission channel number (in this case, "1"), and sets the respective reception channel numbers of the other parts at a value other than the transmission channel number (for example, sets the reception channel number of the other parts at "2", "3", and "4", respectively). In the setting of the reception channel number, which is equivalent to the initial setting of the performance developing, the part whose reception channel number is set at the same value as the transmission channel number is part 1, for example. At step S63, the CPU 62 defines tone range data of all the parts contained in the currently set tone source control data set as representing the full range. By executing this performance developing program, the settings of the performance developing mode are made.

In this state, if the player operates the performance operators 10 to play music, the CPU 62 executes the musical tone signal generating program which is not shown to control, on the basis of the specified tone source control data set, generation of musical tone signals by the tone generator 40, the musical tone signals corresponding to the player's operation. In the musical tone signal generating portions BL3 through BL6 shown in FIG. 9, in this case, on the basis of the control of the gate portions BL31 through BL61 by the comparison portions BL32 through BL62, performance information is supplied only to the tone source channel of the tone signal generating portion which corresponds to the part whose reception channel number has been set at the number of the transmission channel number (e.g., part 1). In the musical tone signal generating portions corresponding to the other parts, performance information will not be supplied to their tone source channels. In this case as well, the tone source control data storage portion of the musical tone signal generating portion to which the performance information has been delivered outputs tone range data representative of the full range, resulting in the musical tone signal generating portion allowing any set of performance information to be unconditionally supplied to its tone source channel through the gate portion which is controlled on the basis of the tone range data. The tone source channel to which the performance information has been delivered generates a musical tone signal having a pitch corresponding to note number data contained in the delivered performance information and having a voice (tone color) specified by voice data stored in the tone source control data storage portion. In this case as well, velocity data contained in the delivered performance information is utilized for the control of loudness, envelope waveform and the like of the musical tone signal to be generated. A musical tone corresponding to the generated musical tone signal is emitted through the sound system 41.

Next, a case where the player operates one or more of the part specifying operators 22*a* through 22*d* in a state where the performance developing mode has been set as described above will be explained. In response to the player's operation of the one or more of the part specifying operators 22*a* through 22*d*, the CPU 62 starts executing the part specifying program at step S70 shown in FIG. 13. After the start of the part specifying program, the CPU 62 determines at step S71 whether the electronic musical instrument is currently in the performance developing mode through the execution of the performance developing program shown in FIG. 12 or not. If a positive determination is made in step S71, the CPU 62 executes the process of step S72.

At step S72, as in the case of the first embodiment, the CPU 62 determines whether generation of musical tone signals (i.e., voice) is assigned to a part/parts that corresponds to the part specifying operator/operators that the player has operated. Only when a positive determination is made at step S72, the CPU 62 execute the process of step S73. At step S73, the reception channel number of the part/parts corresponding to the player's operated part specifying operator/operators is set at the same value as the transmission channel number (in this case as well, "1"), while the reception channel number of the other parts is set at a value other than the transmission channel number (e.g., "2", "3", "4", etc.). In a case where a plurality of part specifying operators have been operated by the player, the respective reception channel numbers of the parts corresponding to the operated part specifying operators may be set at the same value as the transmission channel number as described above. Alternatively, the reception channel number of one of the parts may be set at the same value as the transmission channel number. Then, the player's operation of the performance operators 10 to play music causes generation of musical tone signals having a voice/voices of the specified part/parts.

When the part specifying operator 22*b* has been newly operated, for example, the reception channel number of the part 2 is set at the same value as the transmission channel number, while the respective reception channel numbers of the parts 1,3 and 4 are set at a value other than the transmission channel number. In this case, as a result, the player's operation of the performance operators 10 causes generation of only musical tone signals having the voice of the part 2. In this case as well, the player's operation of any of the performance operators 10 results in generation of a musical tone signal, since the tone range of the part 2 has been defined as the full range by the process of step S63 shown in FIG. 12.

In this state, if another of the part specifying operators 22*a* through 22*d* is newly operated, the part specifying program shown in FIG. 13 is executed again, similarly to the above-described case, resulting in musical tone signals of the part corresponding to the newly operated part specifying operators being generated in accordance with the player's operation of the performance operators 10. In this state, furthermore, if the performance developing operator 25 is operated, the performance developing program shown in FIG. 12 is executed to reset the tone source control data to the initial data for the performance developing.

Figure 13:
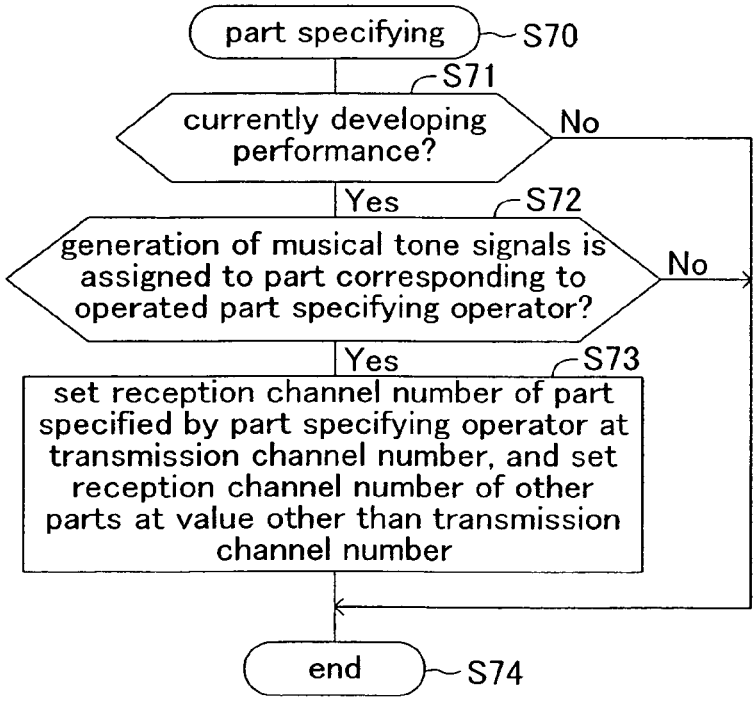
FIG. 13 is a flowchart showing a part specifying program executed by the computer portion shown in FIG. 1 according to the second embodiment of the present invention.

Next, a modified example of the second embodiment will be described. In the modified example, of a plurality of parts, parts having the same tone range are regarded as being included in a group. The player's operation of the performance operators 10 causes every part included in the group to generate musical tone signals. In this modified example, the performance developing program shown in FIG. 12 is replaced with a performance developing program shown in FIG. 14, while the part specifying program shown in FIG. 13 is replaced with a part specifying program shown in FIG. 15. Other configuration of the modified example is similar to that of the second embodiment.

Figure 14:
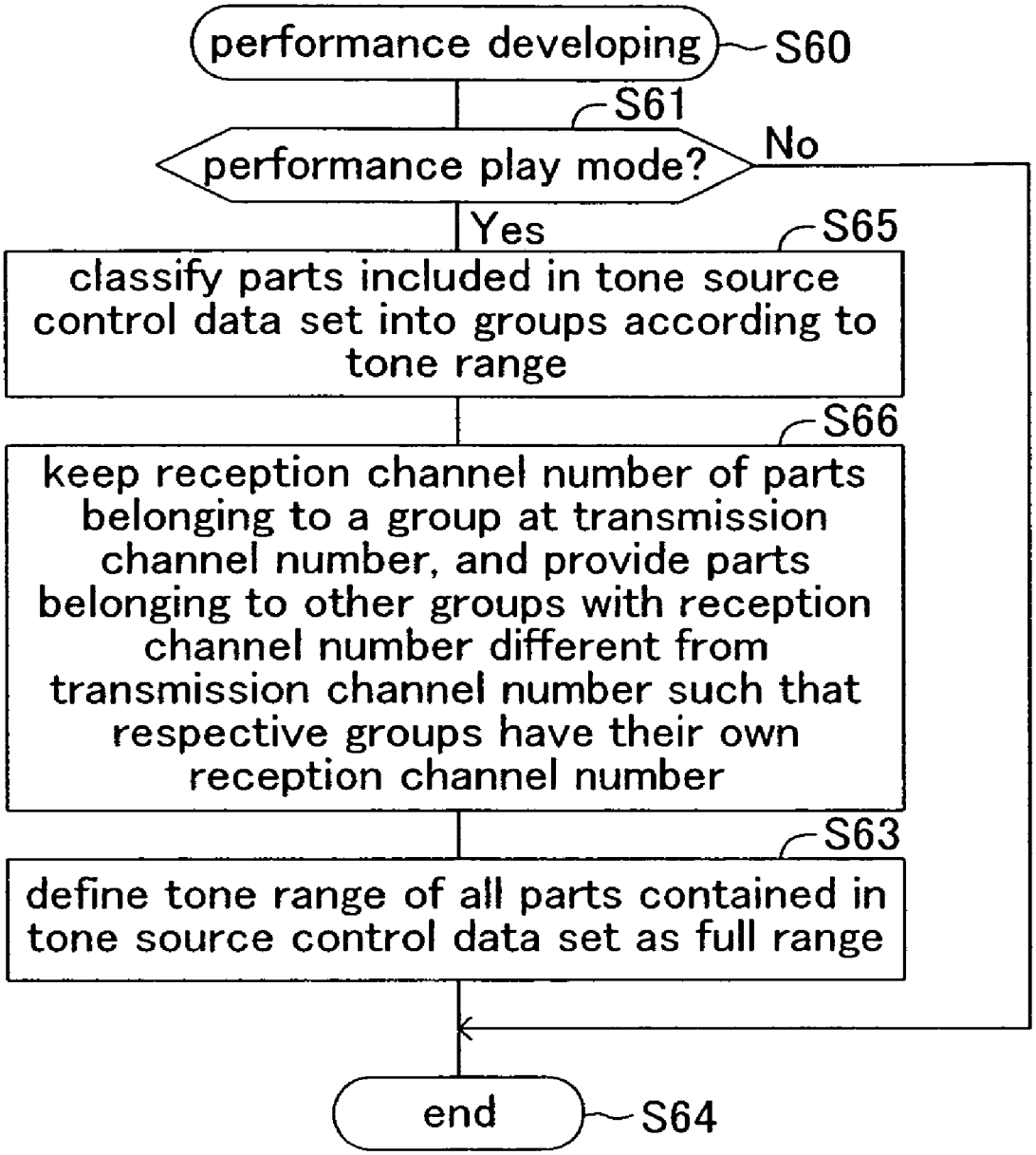
FIG. 14 is a flowchart showing a modified example of the performance developing program shown in FIG. 12.

In the performance developing program shown in FIG. 14, the process of step S62 shown in FIG. 12 is replaced with steps S65, S66. Processes of steps S61, S63 of FIG. 14 are similar to those of steps S61, S63 of FIG. 12. At step S65, the CPU 62 classifies a plurality of parts contained in the tone source control data set into groups such that parts having the same tone range are classified into the same group. When the part 1 has the same tone range as the part 3, for example, the part classification is made such that the parts 1 and 3 belong to the same group.

At step S66, the CPU 62 keeps the reception channel number of one or more of the parts which belongs/belong to one group at the same value as the transmission channel number (in this case, "1"), and sets the respective reception channel numbers of the other parts belonging to the other groups at a value other than the transmission channel number (for example, the CPU 62 sets the reception channel number of the other parts at "2" or "3"). In the setting of the reception channel number, which is equivalent to the initial setting of the performance developing, as in the case of the process of step S62 of FIG. 12, the group which includes the part/parts whose reception channel number is set at the same value as the transmission channel number is a group including part 1, for example.

Figure 15:
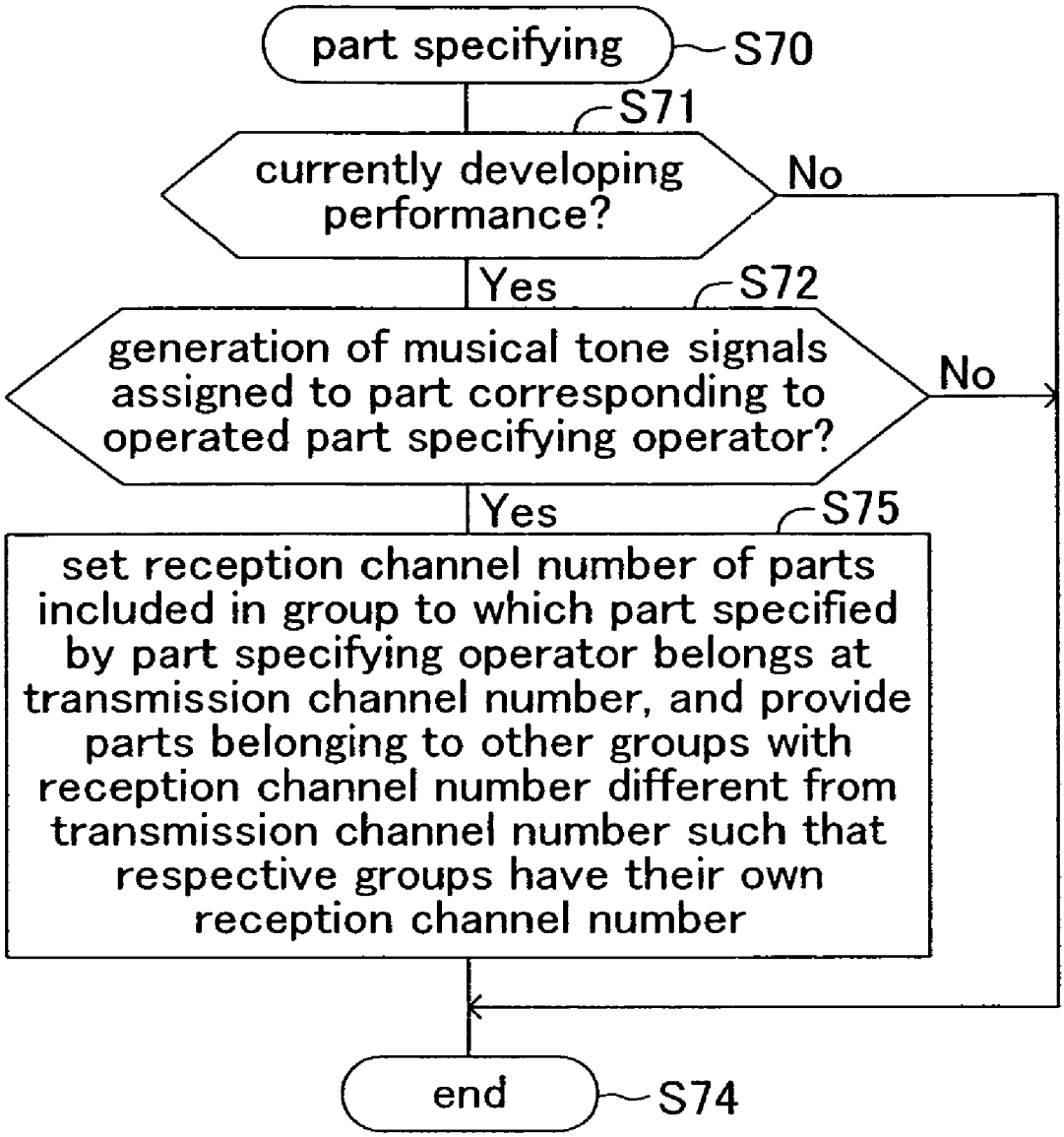
FIG. 15 is a flowchart showing a modified example of the part specifying program shown in FIG. 13.

In the performance developing program shown in FIG. 15, the process of step S73 of FIG. 13 is replaced with a process of step S75. The processes of steps S71, S72 of FIG. 15 are the same as those of steps S71, S72 of FIG. 13. At step S75, the CPU 62 sets the reception channel number of a part/parts belonging to the same group as that to which the part specified by the part specifying operators 22*a* through 22*d* belongs at the same value as the transmission channel number, while the CPU 62 provides the other parts belonging to the other groups with a reception channel number which is different from the transmission channel number, each of the other groups having a different reception channel number.

In this modified example, as described above, the performance developing and the setting of the reception channel number are done on a group basis, the group being composed of one or more parts having the same tone range. As a result, the generation of musical tone signals in response to player's operation of the performance operators 10 is controlled on a group basis. In the performance developing mode, as a result, in a case where a performance data set defines the same tone range for some of the parts, the modified example enables concurrent generation of musical tone signals for the some of the parts. Therefore, the modified example enables the player to concurrently generate, with a simple operation, musical tone signals for his intended parts.

c. Other Modified Examples

In the above-described first and second embodiments and their modified examples, a voice data set is composed of only data which specifies a voice such as tone source waveform, frequency response, effect. Instead of this scheme, however, the voice data set may include tone range data or a reception channel number. In a case where the voice data set includes tone range data, the functional block diagram shown in FIG. 10 is modified such that the gate portion BL34 of FIG. 9 is inserted between the gate portion BL31 and the tone source channel BL35 to control the generation of musical tone signals on the basis of tone range in the voice play mode as well. In a case where the voice data set includes a reception channel number, the processes for setting the reception channel number of step S41 shown in FIG. 6 and step S52 shown in FIG. 7 are unnecessary.

In the above-described first and second embodiments and their modified examples, the transmission channel number added to performance information brought on the basis of the performance operators 10, the reception channel number contained in a performance data set, and the reception channel number added to voice data is "1", respectively. However, any value other than the above (i.e., any value other than "1") may be used as the transmission channel number and the reception channel number. In addition, the player may be allowed to edit the transmission channel number and the reception channel number to change to other values.

For example, if the reception channel number contained in a performance data set and voice data is fixed at "1", respectively, with the transmission channel number contained in performance information brought on the basis of the performance operators 10 being set at a value other than "1", and the transmission channel number contained in performance information delivered from the external MIDI apparatus 71, for example, is set at "1", the electronic musical instrument is allowed to generate musical tone signals based on the performance information delivered from the external MIDI apparatus 71. In addition, in a case where the transmission channel number contained in performance information delivered from the external MIDI apparatus 71 is set at a specified value other than "1", by changing the reception channel number contained in the performance data set and voice data to the specified value, respectively, the electronic musical instrument is allowed to generate musical tone signals based on the performance information delivered from the external MIDI apparatus 71. In short, simply making the transmission channel number from which performance information is delivered agree with the reception channel number of a performance data set and voice data enables the electronic musical instrument to generate musical tone signals in accordance with the performance information delivered from any desired source. In this case as well, the performance developing mode similarly functions by setting the reception channel number of a specified part at the same value as the transmission channel number indicative of the source with the reception channel number of the other parts being set at a value other than the transmission channel number.

In the above-described first and second embodiments and their modified examples, a case in which the settings of a tone source control data set are made for the tone generator 40 incorporated in the electronic musical instrument has been described. In a case where an external tone generator is used as an external MIDI apparatus, however, the settings of a tone source control data set may be made for the external tone generator. In this case, the reception channel number of a performance data set and voice data for the external tone generator is set to agree with the transmission channel number indicative of the source of performance information. When a personal computer is used as the external MIDI apparatus 71, particularly, a software tone generating program may be installed on the personal computer so that the personal computer functions as the external tone generator.

In the above-described first and second embodiments and their modified examples, furthermore, a keyboard instrument is used as the electronic musical instrument. Instead of the keyboard instrument, however, any types of musical instrument such as stringed instrument, wind instrument, and percussion instrument may be used as the electronic musical instrument.

In carrying out the present invention, furthermore, it will be understood that the present invention is not limited to the above-described first and second embodiments and their modified examples, but various modifications may be made without departing from the spirit and scope of the invention.

What is claimed is:

1. A musical tone signal generating apparatus comprising:

a tone generating portion for inputting performance information specifying pitch of respective musical tone signals to be generated, and generating the musical tone signals having a pitch determined on the basis of the input performance information, the tone generating portion having a performance play capability that enables, on the basis of a set of performance information, concurrent generation of musical tone signals having different voices each assigned to one of a plurality of parts;

a performance data set storage portion for previously storing a plurality of performance data sets each of which specifies various voices applied to musical tone signals for a plurality of parts, the musical tone signals being to be concurrently generated by the tone generating portion on the basis of the set of performance information, each of the performance data sets including a plurality of tone range data sets each of which defines a tone range of musical tone signals to be allowed to be generated for one of the parts;

a performance data setting portion for choosing, under user's direction, one of performance data sets stored in the performance data set storage portion, and making settings of the various voices applied to musical tone signals for the plurality of parts in accordance with the chosen performance data set, the musical tone signals being to be generated by the tone generating portion;

a developing portion for enabling generation of musical tone signals for at least one of the plurality of parts and, disabling generation of musical tone signals for the other parts in response to user's direction in a state where respective settings of various voices to be applied to musical tone signals for the plurality of parts have been done by the performance data setting portion; and a tone range defining portion for defining the tone range data of the at least one part as representing a tone range including at least pitches of all the musical tone signals specified by the performance information.

2. A musical tone signal generating apparatus according to claim 1 wherein the developing portion enables, in response to user's designation of at least one of the plurality of parts, generation of musical tone signals for the designated at least one part and disables generation of musical tone signals for the other parts.

3. A musical tone signal generating apparatus according to claim 2 wherein the tone range defining portion defines, in response to the user's designation of at least one of the plurality of parts, tone range data of the designated at least one part as representing a tone range including at least pitches of all the musical tone signals specified by the performance information.

4. A musical tone signal generating apparatus according to claim 1 wherein the developing portion includes:

a first developing portion for enabling generation of musical tone signals for at least one of the plurality of parts, and disabling generation of musical tone signals for the other parts in accordance with predetermined criteria in response to user's instructions for developing; and a second developing portion for changing settings made by the first developing portion such that, in response to user's designation of at least one of the plurality of parts, the generation of musical tone signals for the designated at least one part is enabled with the generation of musical tone signals for the other parts being disabled.

5. A musical tone signal generating apparatus according to claim 4 wherein the tone range defining portion defines, in response to the user's instructions for developing, tone range data of the plurality of parts as representing a tone range including at least pitches of all the musical tone signals specified by the performance information.

6. A musical tone signal generating apparatus according to claim 1 wherein the at least one part for which generation of musical tone signals is enabled by the developing portion includes at least another of the plurality of parts, the at least another having the same tone range as that of the at least one part, the tone range being defined by tone range data included in the performance data set.

7. A musical tone signal generating apparatus according to claim 1 wherein the tone generating portion receives performance information having a transmission channel number representative of a source from which the performance information is delivered, and generates musical tone signals having pitches corresponding to the received performance information on condition that the transmission channel number included in the received performance information agrees with a specified reception channel number;

each of the performance data sets stored in the performance data set storage portion contains reception channel numbers each of which allows generation of musical tone signals in accordance with received performance information on condition that the transmission channel number contained in the performance information agrees with the reception channel number;

the developing portion enables generation of musical tone signals for the at least one part by making a reception channel number for the at least one part agree with the transmission channel number contained in the performance information, and disables generation of musical tone signals for the other parts by making respective reception channel numbers for the other parts disagree with the transmission channel number contained in the performance information.

8. A musical tone signal generating apparatus according to claim 1 wherein the tone generating portion includes not only the performance play capability but also a voice play capability that enables generation of only a musical tone signal having one voice in response to a set of performance information;

the musical tone signal generating apparatus further comprising:

a voice data set storage portion for previously storing a plurality of voice data sets each of which specifies a voice of a musical tone signal to be generated in response to the set of performance information; and a voice data setting portion for choosing, under user's direction, one of the voice data sets stored in the voice data set storage portion, and then making settings of a voice to be applied to a musical tone signal in accordance with the chosen voice data set, the musical tone signal being to be generated by the tone generating portion.

9. A method for a musical tone signal generating apparatus having:

a tone generating portion for inputting performance information specifying pitch of respective musical tone signals to be generated, and generating the musical tone signals having a pitch determined on the basis of the input performance information, the tone generating portion having a performance play capability that enables, on the basis of a set of performance information, concurrent generation of musical tone signals having different voices each assigned to one of a plurality of parts; and a performance data set storage portion for previously storing a plurality of performance data sets each of which specifies various voices applied to musical tone signals for a plurality of parts, the musical tone signals being to be concurrently generated by the tone generating portion on the basis of the set of performance information, each of the performance data sets including a plurality of tone range data sets each of which defines a tone range of musical tone signals to be allowed to be generated for one of the parts;

the method comprising:

a performance data setting step for choosing, under user's direction, one of performance data sets stored in the performance data set storage portion, and making settings of the various voices applied to musical tone signals for the plurality of parts in accordance with the chosen performance data set, the musical tone signals being to be generated by the tone generating portion;

a developing step for enabling generation of musical tone signals for at least one of the plurality of parts, and disabling generation of musical tone signals for the other parts in response to user's direction in a state where respective settings of various voices to be applied to musical tone signals for the plurality of parts have been done by the performance data setting step; and a tone range defining step for defining the tone range data of the at least one part as representing a tone range including at least pitches of all the musical tone signals specified by the performance information.

* * * * *